US006705048B2

(12) United States Patent
Simon

(10) Patent No.: US 6,705,048 B2
(45) Date of Patent: Mar. 16, 2004

(54) MAGNETIC WEATHERSTRIP

(76) Inventor: David Simon, 39016 Lake Shore Dr., Harrison Township, MI (US) 48045

( * ) Notice: Subject to any disclaimer, the term of this patent is extended or adjusted under 35 U.S.C. 154(b) by 0 days.

(21) Appl. No.: 10/184,597

(22) Filed: Jun. 27, 2002

(65) Prior Publication Data

US 2004/0000096 A1 Jan. 1, 2004

(51) Int. Cl.[7] ..... E06B 7/16
(52) U.S. Cl. ..... 49/478.1; 49/506
(58) Field of Search ..... 49/475.1, 478.1, 49/383, 506

(56) References Cited

U.S. PATENT DOCUMENTS

| | | | | |
|---|---|---|---|---|
| 2,627,097 A | * | 2/1953 | Ellis | 49/478.1 |
| 2,959,832 A | * | 11/1960 | Baermann | 49/478.1 |
| 3,124,725 A | * | 3/1964 | Leguillon | 49/478.1 |
| 4,192,101 A | | 3/1980 | White | |
| 4,272,942 A | | 6/1981 | Jackson | |
| 4,409,758 A | | 10/1983 | Dickerson et al. | |
| 4,463,523 A | | 8/1984 | Mailand et al. | |
| 4,480,407 A | | 11/1984 | Needham | |
| 4,510,986 A | | 4/1985 | Schwankl | |
| 4,753,042 A | | 6/1988 | Adkins | |
| 5,150,544 A | | 9/1992 | Burnett | |

FOREIGN PATENT DOCUMENTS

GB 2 063 340 * 6/1981

* cited by examiner

*Primary Examiner*—Jerry Redman

(57) ABSTRACT

A weatherproofing assembly for sealing cracks between a door and a frame associated with the door, and a method of using the weatherstrip assembly. The assembly provides a flexible magnetic strip for sealing the cracks. The strip magnetically attaches to one of the door and the frame such that an overhang portion extends therebeyond. When the door is in a closed position, the overhang portion lies overtop of the cracks. Additionally, the strip may magnetically attach to the other of the door and the frame, thereby better sealing the cracks.

21 Claims, 3 Drawing Sheets

MAGNETIC WEATHERSTRIP

BACKGROUND OF THE INVENTION

The present invention relates to weatherproofing assemblies, and more particularly to a magnetic weatherproofing strip for sealing cracks between a door and an associated door frame.

Ideally, weatherproofing material is easy to install and inexpensive to manufacture. Most weatherproofing assemblies employ the use of adhesives or mechanical attachment means to attach a weatherproofing strip to a door. These assemblies generally contain many different interworking parts and therefore are expensive to manufacture and complicated to install. In addition, the need for adhesive or mechanical attachment means can permanently mar the surface of a door. If the door comprises a magnetic material, a magnetic attachment means could solve this problem. However, current magnetic weatherproofing systems have not eliminated the need for a plurality of parts or still require the use of adhesives in some manner.

Accordingly, it is desirable to provide a weatherproofing assembly that is inexpensive to manufacture and install and simple in construction which quickly and magnetically attaches to either a door or an associated door frame.

SUMMARY OF THE INVENTION

The weatherproofing assembly according to the present invention provides a flexible magnetic strip for sealing cracks between a door and a frame associated with the door. The strip comprises magnetic sheeting and attaches to either the door or the frame so that an overhang portion of the strip extends beyond the door or the frame to which the strip is attached. When the door is in a closed position, the overhang portion lies overtop of the cracks.

The present invention is therefore inexpensive to manufacture and install and simple in construction due to the availability of the material. In addition, the strip quickly attaches to either a door or an associated frame magnetically, significantly reducing installation time and expense.

BRIEF DESCRIPTION OF THE DRAWINGS

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENT

Figure 1:
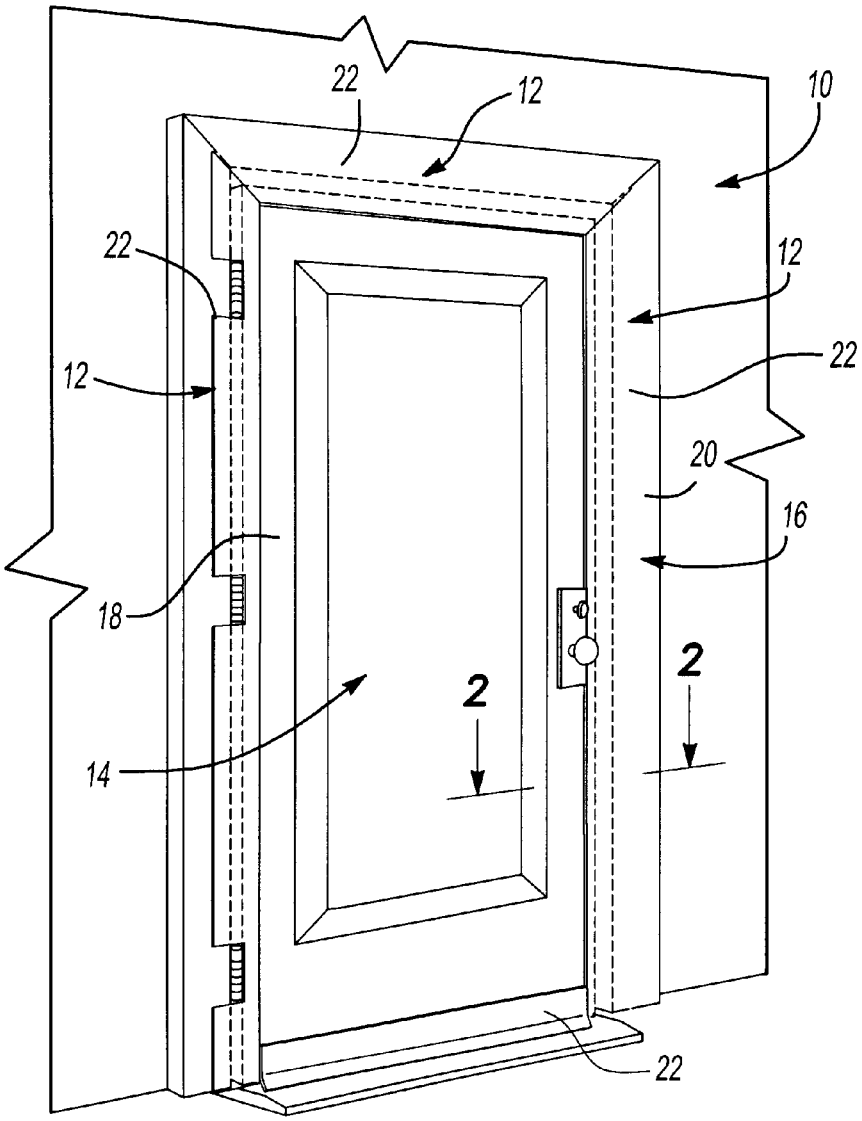
FIG. 1 is a general perspective view of the present invention.

Referring to FIG. 1, the present invention is a weatherproofing assembly 10 including a magnetic strip 12 for sealing cracks (represented by hidden lines) between a door 14 and an associated frame 16. The strip 12 comprises flexible magnetic material such as 30 mil vinyl coated magnetic sheeting and magnetically attaches to either the door 14 or the frame 16, or to both the door 14 and the frame 16. The door 14 is defined as any means of entry into a building or a room and includes a first surface 18. The frame 16 may be a door frame surrounding the door 14, as in FIG. 1, an adjacent door as in a pair of double doors, or any other structure adjacent a door wherein cracks may develop between the structure and the door. The frame 16 includes a frame surface 20 relatively flush with the first surface 18 of the door 14.

Figure 2:
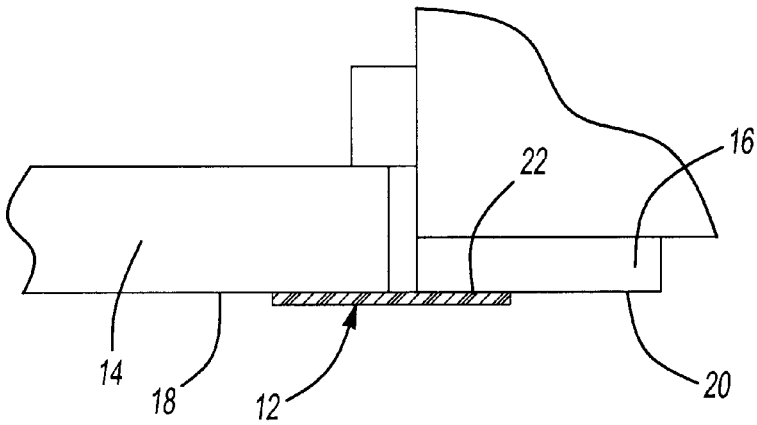
FIG. 2 is an overhead view of the invention in FIG. 1 with the door in the closed position, taken along line 2—2 of FIG. 1.
Figure 3:
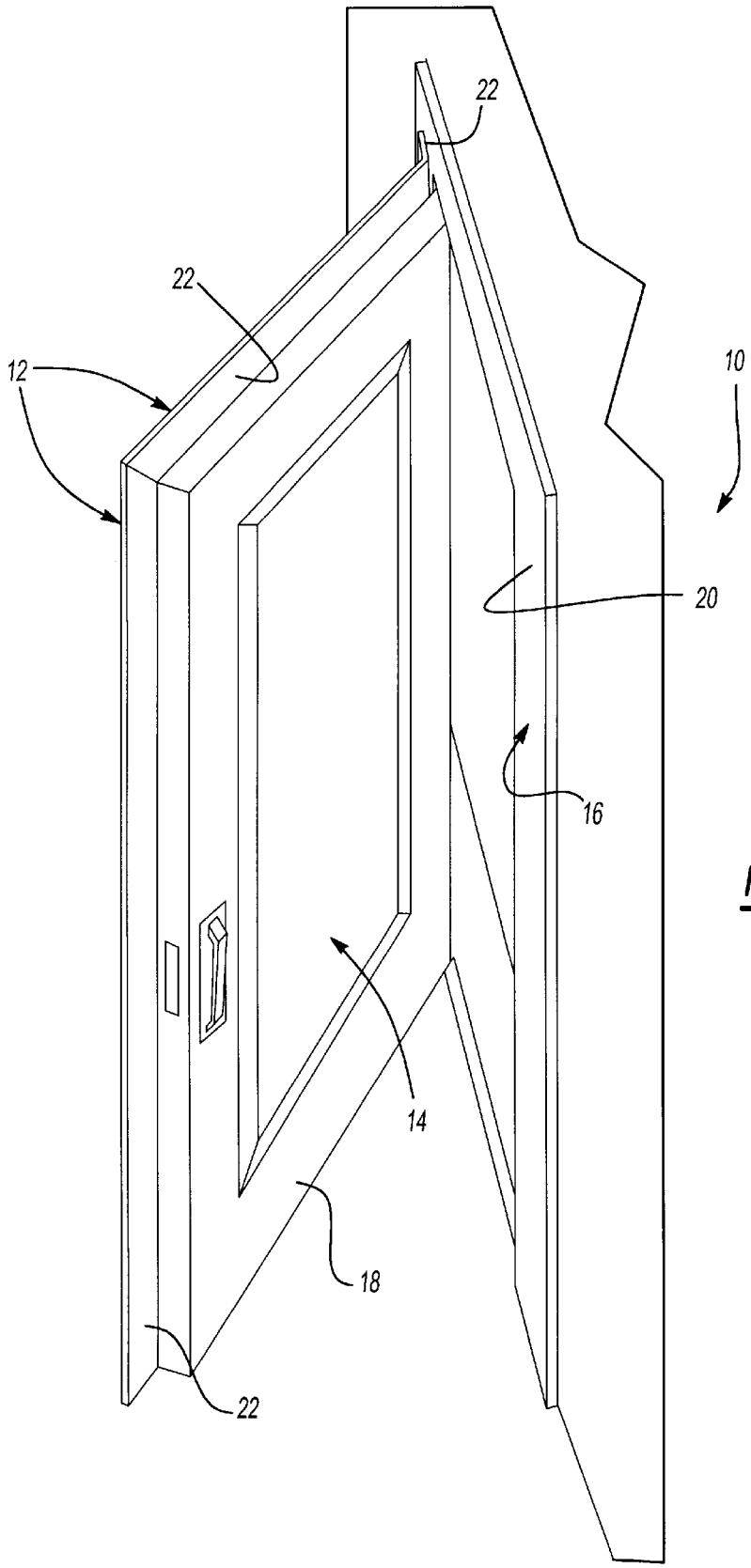
FIG. 3 is a perspective view of a first embodiment of the invention in FIG. 1 with the door in an open position.
Figure 4:
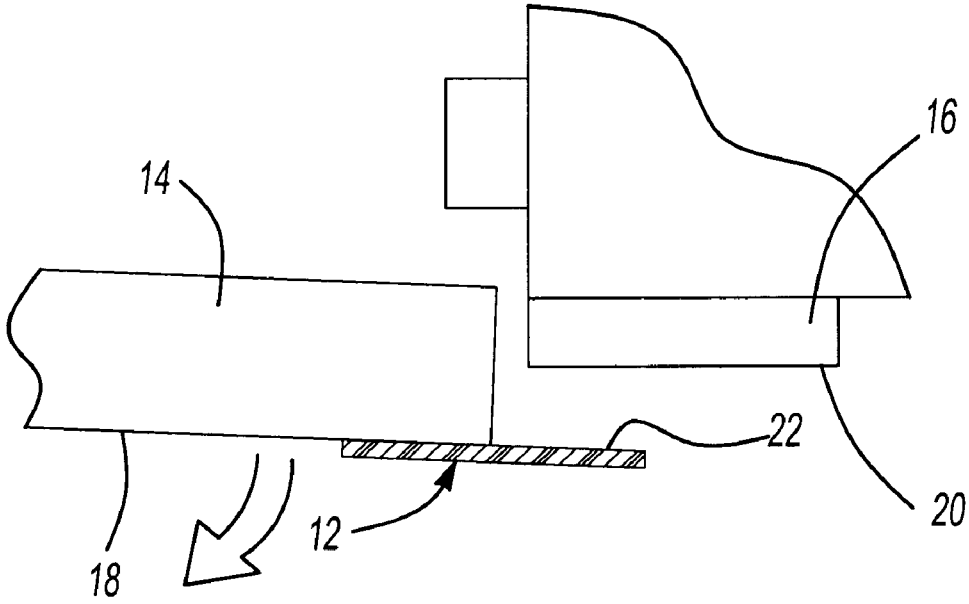
FIG. 4 is an overhead view of the invention in FIG. 3, taken along line 2—2 of FIG. 1.

Referring next to FIG. 2, a first embodiment of the present invention is shown wherein the first surface 18 of the door 14 comprises a magnetic material while the frame surface 20 may or may not comprise a magnetic material. The strip 12 lays flat against and magnetically adheres to the first surface 18 leaving an overhang portion 22 extending beyond the door 14. When the door 14 is in a closed position as in FIG. 2, the overhang portion 22 lies against the frame surface 20 for sealing the cracks. FIG. 3 shows the door 14 moving from the closed position to an open position such that the strip 12 does not interfere with the frame 16. As the door 14 opens, the strip 12 remains attached to the door 14 and moves away from the frame 16 (FIG. 4). Closing the door 14 allows the strip 12 to again cover the cracks between the door 14 and the frame 16.

When the frame surface 20 also comprises a magnetic material, the strip 12 magnetically adheres to both the door 14 and the frame 16 when in the closed position for better sealing the cracks. The strip 12 must be placed so the overhang portion 22 adheres more strongly to the frame surface 20 than it does to the first surface 18; otherwise as the door 14 opens, the strip 12 will remain attached to the frame 16, causing the door 14 to contact the strip 12 as it returns to the closed position. If the magnetic properties of the first surface 18 are equal to the magnetic properties of the frame surface 20, this can be achieved by ensuring that the width of the portion of the strip 12 attached to the door 14 is greater than the width of the overhang portion 22. This may also be achieved by ensuring that the first surface 18 has a higher magnetic strength than the frame surface 20 and adjusting the widths of the attached and overhang portions of the strip 12 accordingly.

Figure 5:
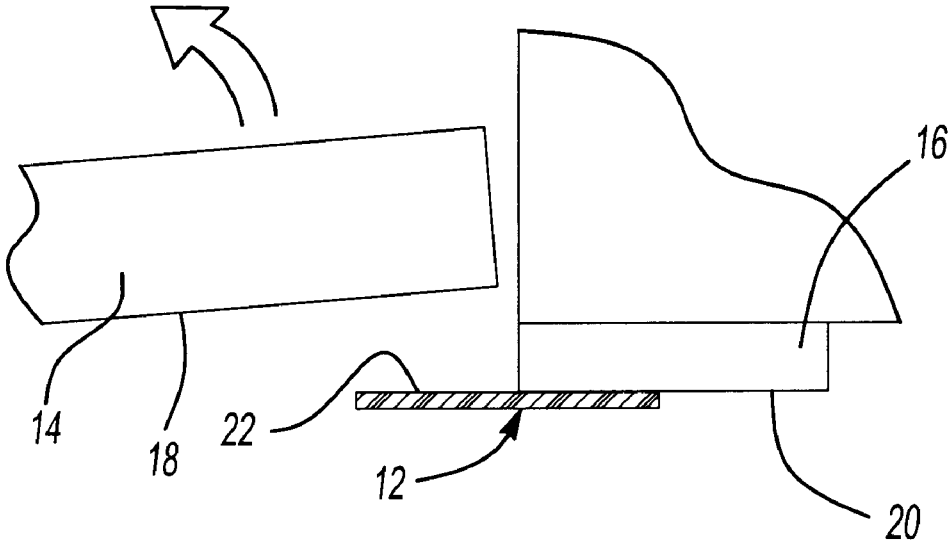
FIG. 5 is an overhead view of a second embodiment of the present invention with the door in the open position, taken along line 2—2 of FIG. 1.

In a second embodiment of the present invention, the frame surface 20 comprises a magnetic material while the inner surface 18 of the door 14 may or may not comprise a magnetic material. The strip 12 lays flat against and magnetically adheres to the frame surface 20 leaving the overhang portion 22 extending beyond the frame 16. When the door 14 is in the closed position, the overhang portion 22 lies against the door 14 for sealing the cracks. Opening the door 14 (FIG. 5) moves the door 14 away from both the frame 16 and the attached strip 12. Closing the door 14 allows the strip 12 to again cover the cracks between the door 14 and the frame 16. When the first surface 18 of the door 14 also comprises a magnetic material, the strip 12 magnetically adheres to both the frame 16 and the door 14 when in the closed position for better sealing the cracks. In this embodiment, as with the first embodiment, it is important to place the strip 12 so the overhang portion 22 adheres more strongly to the frame 16 than to the door 14.

In each of the preferred embodiments described above, either the door 14 or the frame 16 is magnetic such that the magnetic strip 12 magnetically adheres to either the door 14 or the frame 16 or both. It should be appreciated, however, that the strip 12 may attach to either the door 14 or the frame 16 using adhesive. If the strip 12 is adhesively attached, neither the door 14 nor the frame 16 need be magnetic.

In each embodiment, the strip 12 may be cut to any length and width to fit the specific dimensions of the door 14 as needed. In addition, the flexibility of the strip 12 allows the present invention to be utilized along any edge of the door 14. For instance, manufacturing the strip 12 out of a more flexible material would allow effective use of the invention on a hinged edge or threshold of a door 14, as best shown in FIG. 1.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A weatherproofing assembly for sealing a gap between a door and an associated frame, said assembly comprising:

the door including a first surface;

the frame associated with said door and including a frame surface substantially flush with the first surface of the door and spaced from the first surface of the door by the gap; and a flexible magnetic strip having a magnetic portion contacting the first surface and the frame surface across the gap and magnetically attached to at least one of the first surface and the frame surface to seal the gap.

2. The assembly as recited in claim 1 wherein the first surface comprises a magnetic material such that said strip magnetically adheres to said first surface.

3. The assembly as recited in claim 2 wherein the frame surface comprises a magnetic material such that the strip magnetically adheres to said frame surface for sealing cracks between said door and said frame.

4. The assembly as recited in claim 1 wherein the frame surface comprises a magnetic material such that said strip magnetically adheres to said frame surface.

5. The assembly as recited in claim 1 wherein said strip comprises vinyl coated magnetic sheeting.

6. The assembly as recited in claim 1 wherein the door includes an interior surface, an opposite exterior surface and an edge surface perpendicular to and positioned between the interior surface and the exterior surface, and wherein the first surface of the door is one of the interior surface of the door or the exterior surface of the door.

7. The assembly as recited in claim 6 wherein the frame includes an interior surface, an opposite exterior surface and an edge surface perpendicular to and positioned between the interior surface and the exterior surface, and wherein the frame surface of the frame is the interior surface of the frame or the exterior surface of the frame.

8. The assembly as recited in claim 1 wherein the flexible magnetic strip includes at least one cutout portion into which is received a hinge connecting the door to the frame.

9. A method of using a weatherproofing assembly for sealing a gap between a door and an associated frame, said method comprising the step of:

(a) magnetically attaching at least one magnetic strip to at least one of a first surface of the door and a frame surface of the frame, the frame surface being substantially flush with the first surface of the door, such that a magnetic portion of the strip overlies the first surface of the door and the frame surface of the frame and such that the strip overlies the gap between the door and the frame when the door is in a closed position adjacent the frame.

10. The method as recited in claim 9 wherein said door comprises a magnetic material and wherein step (a) further includes the step of magnetically attaching said strip to said door.

11. The method as recited in claim 10 wherein step (a) is further defined by attaching said strip parallel to the first surface of the door such that an overhang portion extends beyond said door to lie against said frame when said door is in a closed position.

12. The method as recited in claim 11 further comprising the steps of:

(b) moving said door from the closed position to an open position, thereby moving said strip away from said frame; and (c) returning said door to a closed position such that said strip lies against said frame for sealing cracks between said door and said frame.

13. The method as recited in claim 11 wherein said frame comprises a magnetic material, and wherein step (a) further includes the step of magnetically attaching said strip to said frame.

14. The method as recited in claim 13 further comprising the step of:

(b) moving said door from the closed position to an open position, thereby moving said strip away from said frame and such that said strip detaches from said frame while remaining attached to said door;

(c) returning said door to the closed position; and (d) magnetically reattaching said overhang portion to said frame for scaling cracks between said door and said frame.

15. The method as recited in claim 14 wherein said frame comprises a magnetic material, and wherein step (a) further includes the step of magnetically attaching said strip to said frame.

16. The method as recited in claim 9 wherein said frame comprises a magnetic material and wherein step (a) further includes the step of magnetically attaching said strip to said frame.

17. The method as recited in claim 16 wherein step (a) further includes the step of attaching said strip parallel to said frame surface such that an overhang portion extends beyond said frame to lie against the first surface of said door when said door is in a closed position.

18. The method as recited in claim 17 further comprising the steps of:

(b) moving said door from the closed position to an open position, thereby moving said door away from said strip; and (c) returning said door to the closed position such that said strip lies against the first surface of said door for sealing cracks between said door and said frame.

19. The method as recited in claim 17 wherein said door comprises a magnetic material, and wherein step (a) further includes the step of magnetically attaching said strip to the first surface of said door.

20. The method as recited in claim 19 further comprising the step of:

(b) moving said door from the closed position to an open position, thereby moving said door away from said strip such that said strip detaches from said door while remaining attached to said frame;

(c) returning said door to the closed position; and (d) magnetically reattaching said overhang portion to said frame.

21. The method of claim 9 further including the steps of:

(b) moving the door from the closed position to an open position away from the frame, thereby moving the strip away from the other of the first surface of the door and the frame surface of the frame; and (c) returning the door to the closed position such that the strip lies against the first surface and the frame surface and seals the gap between the door and the frame.

* * * * *

UNITED STATES PATENT AND TRADEMARK OFFICE

CERTIFICATE OF CORRECTION

PATENT NO. : 6,705,048 B2
DATED : March 16, 2004
INVENTOR(S) : Simon

It is certified that error appears in the above-identified patent and that said Letters Patent is hereby corrected as shown below:

Column 4,
Line 35, “scaling” should read as-- sealing --

Signed and Sealed this

Twenty-fifth Day of May, 2004

JON W. DUDAS
*Acting Director of the United States Patent and Trademark Office*